US009849684B2

(12) United States Patent
Lee

(10) Patent No.: US 9,849,684 B2
(45) Date of Patent: Dec. 26, 2017

(54) INK CARTRIDGE FOR INKJET PRINTER

(71) Applicant: WOOSIM SYSTEM CO., LTD., Seoul (KR)

(72) Inventor: Il Bok Lee, Gyeonggi-do (KR)

(73) Assignee: WOOSIM SYSTEM INC., Seoul (KR)

( * ) Notice: Subject to any disclaimer, the term of this patent is extended or adjusted under 35 U.S.C. 154(b) by 0 days.

(21) Appl. No.: 15/100,331

(22) PCT Filed: Mar. 27, 2015

(86) PCT No.: PCT/KR2015/003062
§ 371 (c)(1),
(2) Date: May 30, 2016

(87) PCT Pub. No.: WO2016/013749
PCT Pub. Date: Jan. 28, 2016

(65) Prior Publication Data

US 2017/0129248 A1 May 11, 2017

(30) Foreign Application Priority Data

Jul. 24, 2014 (KR) ..... 10-2014-0093845

(51) Int. Cl.
*B41J 2/175* (2006.01)
*B41J 2/14* (2006.01)

(52) U.S. Cl.
CPC ..... *B41J 2/17526* (2013.01); *B41J 2/17553* (2013.01); *B41J 2/14072* (2013.01); *B41J 2/1753* (2013.01); *B41J 2002/14491* (2013.01)

(58) Field of Classification Search
None
See application file for complete search history.

(56) References Cited

U.S. PATENT DOCUMENTS

2005/0243130 A1* 11/2005 Essen ..... B41J 2/14072 347/50

FOREIGN PATENT DOCUMENTS

JP 2005-0167235 A 6/2005
KR 10-2005-0081158 A 8/2005
(Continued)

OTHER PUBLICATIONS

Machine Translation of KR 10-2006-0008159 A, Choi, Sik-Seon, "Bonding structure for ink jet cartridge head and bonding method thereof", Jan. 26, 2006, Samsung Electronics Co., Ltd, p. 2, paragraph 1-p. 2, paragraph 3; p. 7, paragraphs 1-3.*
(Continued)

*Primary Examiner* — Lisa M Solomon
(74) *Attorney, Agent, or Firm* — Barcelo, Harrison & Walker, LLP

(57) ABSTRACT

The present invention relates to an ink cartridge for an inkjet printer, the ink cartridge comprising a head chip of a print head to be surface-mounted on an FPCB by means of BGA so as to have each contact terminal, which is formed on the FPCB and the head chip, to be formed over a relatively wide area and therefore not require a high level of integration technology. Therefore, the ink cartridge enables easy manufacturing of the FPCB and the head chip and lowering of manufacturing cost. Also, since relatively low precision needs to be maintained during the mounting of the head chip on the FPCB such that each contact terminal comes into contact, the ink cartridge enables more convenient and faster manufacturing of the print head.

8 Claims, 7 Drawing Sheets

(56) References Cited

FOREIGN PATENT DOCUMENTS

| | | | |
|---|---|---|---|
| KR | 10-2006-0008159 | A | 1/2006 |
| KR | 10-2006-0015993 | A | 2/2006 |
| KR | 10-0645434 | B1 | 11/2006 |
| KR | 10-2009-0085981 | A | 8/2009 |

OTHER PUBLICATIONS

Japanese Patent Abstract (in English) of JP Pub. No. 2005-0167235 A, Pub. Date Jun. 23, 2005, downloaded from Selected Gazette.
Korean Patent Abstract (in English) of KR Pub. No. 10-2005-0081158 A, Pub. Date Aug. 18, 2005, downloaded May 26, 2016, from http://kpa.kipris.or.kr/kpa/.
Korean Patent Abstract (in English) of KR Pub. No. 10-2006-0008159 A, Pub. Date Jan. 26, 2006, downloaded May 26, 2016, from http://kpa.kipris.or.kr/kpa/.
Korean Patent Abstract (in English) of Kr Pub. No. 10-2006-0015993 A, Pub. Date Feb. 21, 2006, downloaded May 26, 2016, from http://kpa.kipris.or.kr/kpa/.
Korean Patent Abstract (in English) of KR Pub. No. 10-2009-0085981 A, Pub. Date Aug. 10, 2009, downloaded Sep. 27, 2016, from http://kpa.kipris.or.kr/kpa/.
Korean Patent Abstract (in English) of KR Patent No. 10-0645434 81, Reg. Date Nov. 6, 2006, downloaded Apr. 12, 2017, from http://engpat.kipris.or.kr/engpat/.

* cited by examiner

INK CARTRIDGE FOR INKJET PRINTER

CROSS-REFERENCE TO RELATED APPLICATIONS

This application is the national stage for International Patent Cooperation Treaty Application PCT/KR2015/003062, filed Mar. 27, 2015, which claims priority from Korean Patent Application No. 10-2014-0093845, filed Jul. 24, 2014, in the Korean Intellectual Property Office. The entire contents of said applications are incorporated herein by reference for all purposes.

BACKGROUND

Technical Field

The present invention relates to an ink cartridge for an inkjet printer, and more particularly, to an ink cartridge for an inkjet printer, in which since each of contact terminals formed on a flexible printed circuit board (FPCB) and a head chip of a print head is formed on a large area by surface-mounting the head chip on the FPCB in a ball grid array (BGA) manner, a high level of integration technology is not required, hence the FPCB and the head chip are easily manufactured and manufacturing costs thereof are decreased, since a low level of precision needs to be maintained while mounting the head chip on the FPCB such that the contact terminals contact each other, the print head is conveniently and quickly manufactured, and since a high level of precise minute manufacturing technology is not required by disposing the contact terminal formed on the FPCB to have optimum space efficiency, the ink cartridge is easily manufactured and the head chip and the FPCB are further easily connected to each other.

Background Art

Generally, an ink cartridge used in an inkjet printer includes an ink fountain in which ink is stored and a head unit ejecting ink, wherein print is performed as ink is ejected from the head unit onto a paper according to a print command of the printer.

FIG. 1 is a perspective view schematically illustrating a structure of a general ink cartridge for an inkjet printer according to a related art, and FIG. 2 is a perspective view schematically illustrating a structure of a general print head according to a related art.

Generally, as shown in FIG. 1, an ink cartridge for an inkjet printer includes a housing body 100 storing ink in an internal space and a print head 200 mounted on the housing body 100 to discharge the ink stored in the housing body 100.

The print head 200 includes a flexible printed circuit board (FPCB) 210 combined to one side of the housing body 100, and a head chip 220 including a plurality of ejection nozzles for discharging the ink and mounted on the FPCB 210. Pattern circuits (not shown) for controlling operations of the head chip 220 is formed on the FPCB 210, and the head chip 220 performs an operation for accurately discharging the ink while exchanging an electric signal with a printer body through the FPCB 210.

As shown in FIG. 2, the head chip 220 may be mounted on the FPCB 210 as a plurality of chip contact terminals 222 formed at an edge of one side edge of the print head 200 and a plurality of board contact terminals 212 formed on the FPCB 210 contact each other.

In more detail, a head chip mounting portion 211 that is a region on which the head chip 220 is mountable is formed at one side of the FPCB 210, and the plurality of board contact terminals 212 are formed at one side edge of the head chip mounting portion 211 on locations corresponding to the chip contact terminals 222 of the head chip 220. When the head chip 220 is accommodated on the head chip mounting portion 211 of the FPCB 210 according to such a structure, the chip contact terminals 222 of the head chip 220 and the board contact terminals 212 of the FPCB 210 contact each other, and at this time, the head chip 220 is mounted on the FPCB 210 by soldering the terminals.

Here, the plurality of chip contact terminals 222 and the plurality of board contact terminals 212 are formed in relatively narrow sections respectively in the head chip 220 and the FPCB 210, and in addition, the pattern circuits (not shown) respectively connected to the board contact terminals 212 are formed in the FPCB 210.

Accordingly, while manufacturing the print head 200 of the ink cartridge, the plurality of chip contact terminals 222 and the plurality of board contact terminals 212 need to be formed in very narrow sections, and thus a high level of a precise integration technology is required. The necessity of such a high level of an integration technology is further increasing according to a recent upward trend of print resolution. Also, while connecting the head chip 220 to the FPCB 210, a high level of a precise connection technology is also required since connection locations need to be accurately maintained such that the board contact terminals and the chip contact terminals 222 are correspondingly connected to each other.

Accordingly, it is very difficult and complicated to manufacture the ink cartridge, and in addition, highly precise equipment is required to manufacture the ink cartridge, and thus manufacturing costs are high.

DETAILED DESCRIPTION OF THE INVENTION

Technical Problem

One or more embodiments of the present invention provide an ink cartridge for an inkjet printer, in which since each of contact terminals formed on a flexible printed circuit board (FPCB) and a head chip of a print head is formed on a large area by surface-mounting the head chip on the FPCB in a ball grid array (BGA) manner, a high level of integration technology is not required, hence the FPCB and the head chip are easily manufactured and manufacturing costs thereof are decreased, and since a low level of precision needs to be maintained while mounting the head chip on the FPCB such that the contact terminals contact each other, the print head is conveniently and quickly manufactured.

One or more embodiments of the present invention provide an ink cartridge for an inkjet printer, in which since a high level of precise minute manufacturing technology is not required by disposing a contact terminal formed on an FPCB to have optimum space efficiency, the ink cartridge is easily manufactured and a head chip and the FPCB are further easily connected to each other.

Technical Solution

According to an aspect of the present invention, there is provided an ink cartridge for an inkjet printer, the ink cartridge including: a housing body storing ink in an internal space; and a print head mounted on the housing body such as to discharge the ink stored in the housing body, wherein the print head includes a flexible printed circuit board (FPCB) combined to one side of the housing body, and a head chip including a plurality of ejection nozzles to discharge ink and mounted on the FPCB, wherein the head chip is mounted on the FPCB in a ball grid array (BGA) manner.

The FPCB may include a head chip mounting portion in which a plurality of board contact terminals are formed in the BGA manner in an inner region such that the head chip is mounted in the BGA manner, and the head chip may be mounted on the head chip mounting portion in the BGA manner as a plurality of chip contact terminals are formed in the BGA manner at locations corresponding to the plurality of board contact terminals.

A plurality of pattern circuits may be formed on the FPCB to be respectively connected to the plurality of board contact terminals, and the plurality of pattern circuits may be continuously formed throughout the inner region and an outer region of the head chip mounting portion.

The plurality of board contact terminals may be spaced apart from each other at regular intervals along a first line passing through a center portion of the head chip mounting portion and second lines that are parallel to the first line and are bilaterally symmetrical to each other based on the first line, wherein the board contact terminals disposed along the first line and the board contact terminals disposed along the second lines may be misaligned in a direction perpendicular to the first line.

The two adjacent board contact terminals disposed along the first line and one board contact terminal from among the board contact terminals disposed along the second lines may be disposed in a shape of an isosceles triangle in which a section between the two adjacent board contact terminals disposed along the first line is a base line.

A height h of the isosceles triangle may be lower than a height h' of an equilateral triangle of which a length of one side is same as the base line.

The plurality of pattern circuits respectively connected to the plurality of board contact terminals may include parallel portions that are parallel to the first line in the inner region of the head chip mounting portion, and slope portions extending from one ends of the parallel portions in a direction slantly crossing the first line.

Some of the plurality of pattern circuits respectively connected to the plurality of board contact terminals may be formed in a direction in which the slope portions cross sections between the plurality of board contact terminals.

Advantageous Effects

According to the present invention, since each of contact terminals formed on a flexible printed circuit board (FPCB) and a head chip of a print head is formed on a large area by surface-mounting the head chip on the FPCB in a ball grid array (BGA) manner, a high level of integration technology is not required, hence the FPCB and the head chip are easily manufactured and manufacturing costs thereof are decreased, and since a low level of precision needs to be maintained while mounting the head chip on the FPCB such that the contact terminals contact each other, the print head is conveniently and quickly manufactured.

Also, since a high level of precise minute manufacturing technology is not required by disposing the contact terminal formed on the FPCB to have optimum space efficiency, an ink cartridge is easily manufactured and the head chip and the FPCB are further easily connected to each other.

DETAILED DESCRIPTION

Best Mode

Figure 1:
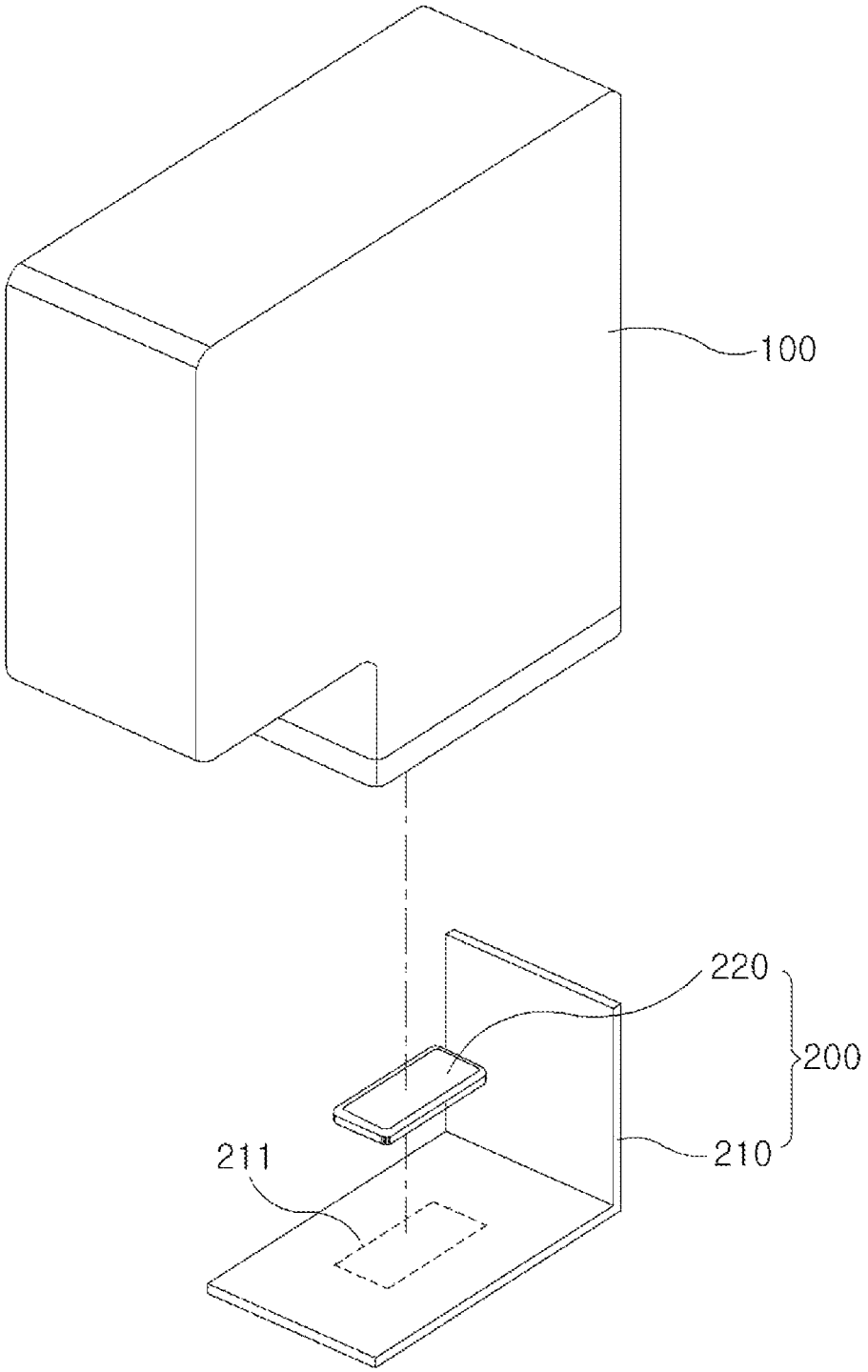
FIG. 1 is a perspective view schematically illustrating a structure of a general ink cartridge for an inkjet printer according to a related art.
Figure 2:
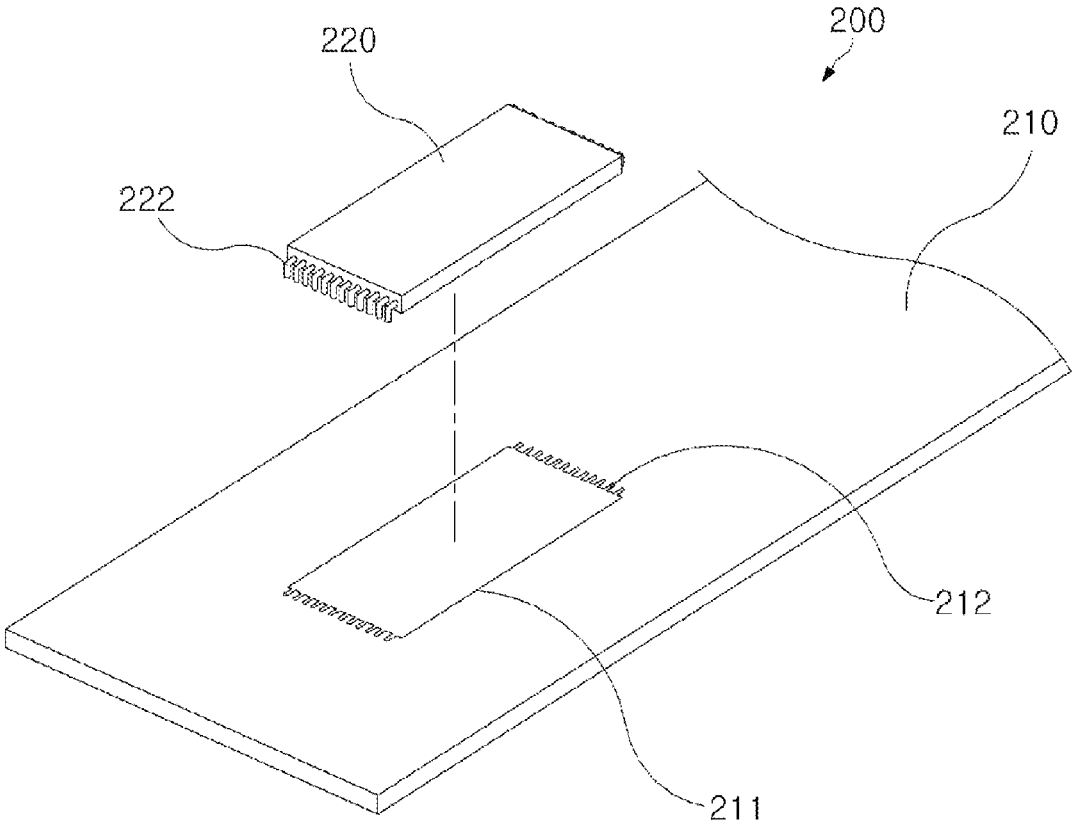
FIG. 2 is a perspective view schematically illustrating a structure of a general print head according to a related art.

Hereinafter, one or more embodiments of the present invention will now be described with reference to accompanying drawings. First, in drawings, like reference numerals denote like elements. Also, in the description of the present invention, certain detailed explanations of related art are omitted when it is deemed that they may unnecessarily obscure the essence of the invention.

Figure 3:
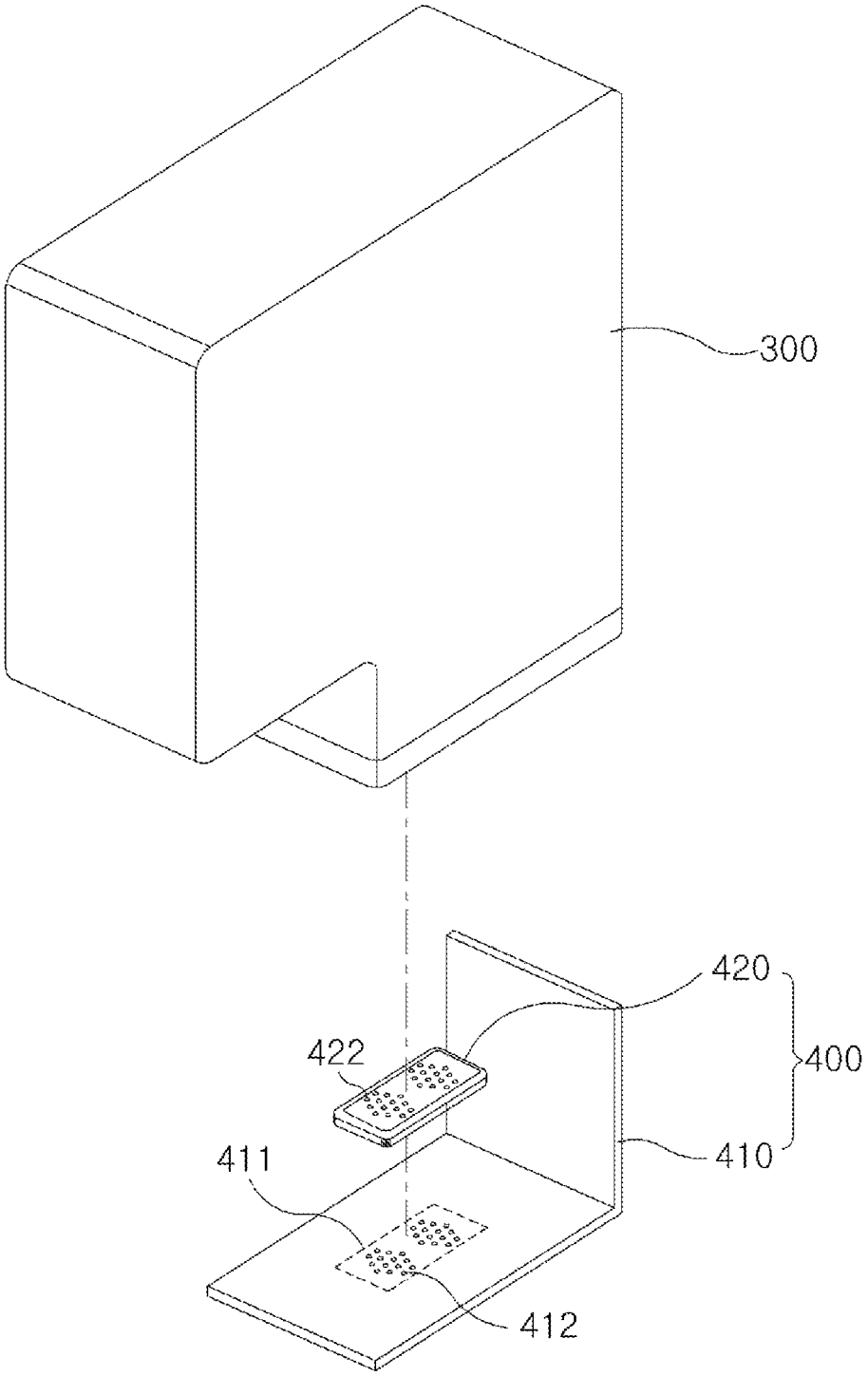
FIG. 3 is a perspective view schematically illustrating a structure of an ink cartridge for an inkjet printer, according to an embodiment of the present invention.
Figure 4:
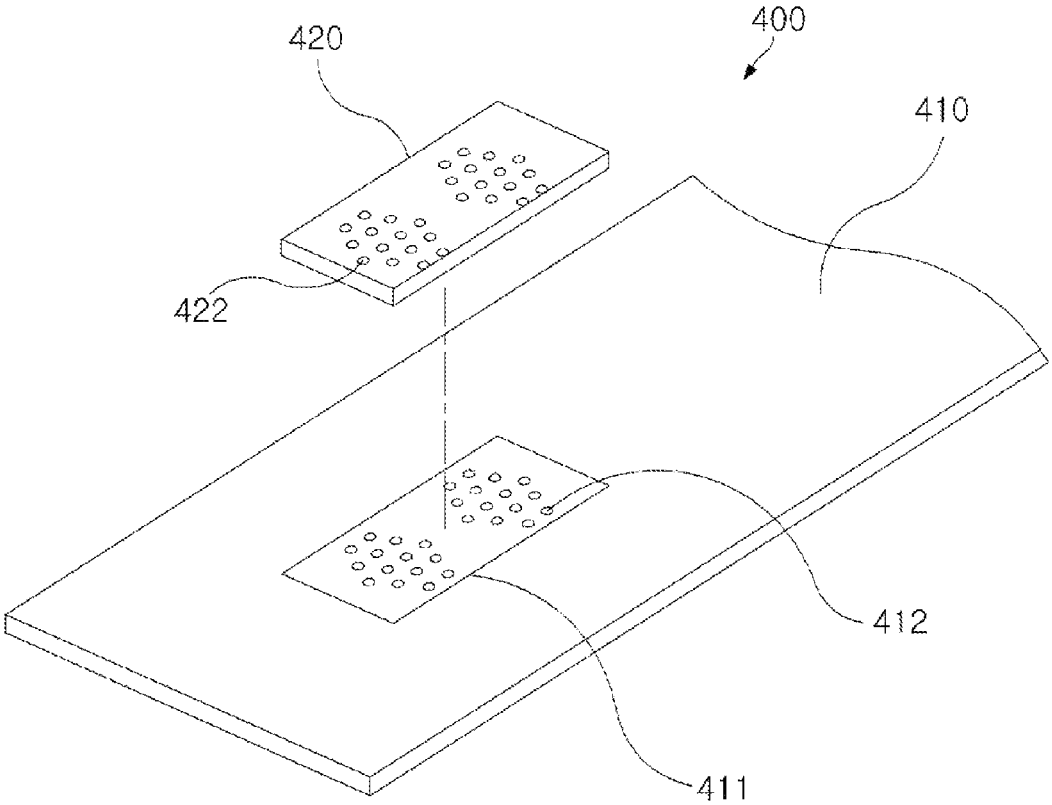
FIG. 4 is a perspective view schematically illustrating a structure of a print head, according to an embodiment of the present invention.

FIG. 3 is a perspective view schematically illustrating a structure of an ink cartridge for an inkjet printer, according to an embodiment of the present invention, and FIG. 4 is a perspective view schematically illustrating a structure of a print head, according to an embodiment of the present invention.

As shown in FIG. 3, the ink cartridge for the inkjet printer, according to an embodiment of the present invention includes a housing body 300 formed in a container shape to store ink in an internal space, and a print head 400 mounted on the housing body 300 to externally discharge the ink stored in the internal space of the housing body 300.

The print head 400 includes a flexible printed circuit board (FPCB) 410 combined to one side of the housing body 300, and a head chip 420 including a plurality of ejection nozzles 423 (refer to FIG. 7) for discharging ink. The head chip 420 is mounted on the FPCB 410 and performs an operation while exchanging an electric signal with a printer body (not shown).

Here, the head chip 420 is mounted on the FPCB 410 in a ball grid array (BGA) manner according to an embodiment of the present invention. BGA is one of technologies of mounting a chip on a surface of a PCB, wherein hemispherical contact terminals, such as solder, are formed on a chip and a board and are connected to each other, and is an advantageous surface mounting technology in terms of space efficiency since a contact pin or lead protruding along an edge of the chip is not required.

In detail, the FPCB 410 includes a head chip mounting portion 411 including a plurality of board contact terminals 412 in a BGA manner in an inner region such that the head chip 420 is mounted in a BGA manner, and the head chip 420 includes a plurality of chip contact terminals in a BGA manner at locations corresponding to the board contact terminals 412 to be mounted on the head chip mounting portion 411 in a BGA manner.

In other words, the FPCB 410 includes, as a region on which the head chip 420 is mountable, the head chip mounting portion 411 having the same or similar shape and size as the head chip 420, and the plurality of board contact terminals 412 are formed in the inner region of the head chip mounting portion 411. A plurality of chip contact terminals 422 are correspondingly formed at one side surface of the head chip 420. The board contact terminal 412 and the chip contact terminal 422 may be formed via soldering, and may have a hemispherical shape. Also, the chip contact terminals 422 of the head chip 420 and the board contact terminals 412 of the FPCB 410 are formed on corresponding locations to correspondingly contact each other while the head chip 420 is mounted on the head chip mounting portion 411 of the FPCB 410.

According to such a structure, the print head 400 of the ink cartridge according to an embodiment of the present invention has excellent space efficiency compared to the related art since the contact terminals 412 and 422 respectively formed in the FPCB 410 and the head chip 420 are formed in relatively large areas, and accordingly, a high level of a precise integration technology is not required unlike the related art, and thus not only manufacturing of the print head 400 is easy, but also manufacturing costs are decreased. Also, individual sizes of the contact terminals 412 and 422 may be relatively largely increased, and accordingly, the contact terminals 412 and 422 may correspondingly contact each other even if a high level of precision with respect to location alignment is not maintained while mounting the head chip 420 on the FPCB 410, and thus manufacturing processes may be conveniently performed.

Next, arrangement structures of the contact terminals 412 and 422 respectively formed on the FPCB 410 and the head chip 420 will be described in detail.

Figure 5:
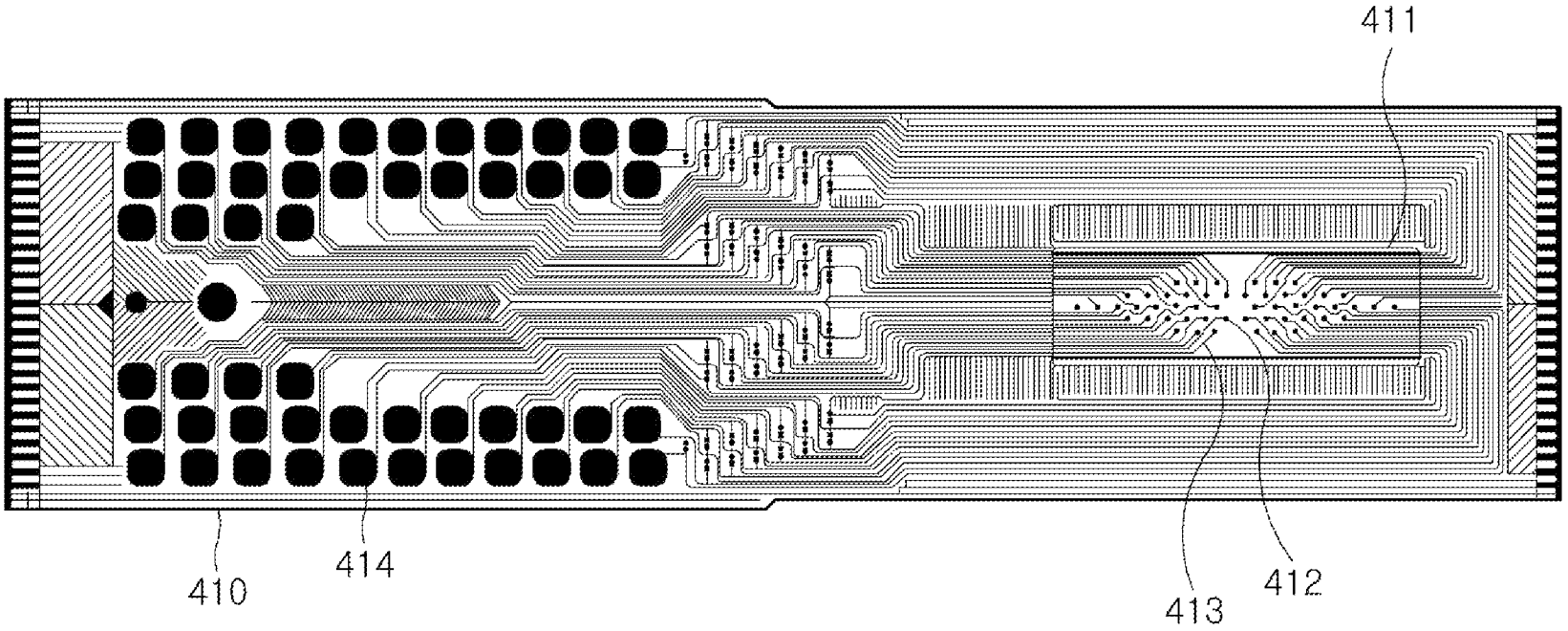
FIG. 5 is an exemplary view of a shape of a flexible printed circuit board (FPCB), according to an embodiment of the present invention.
Figure 6:
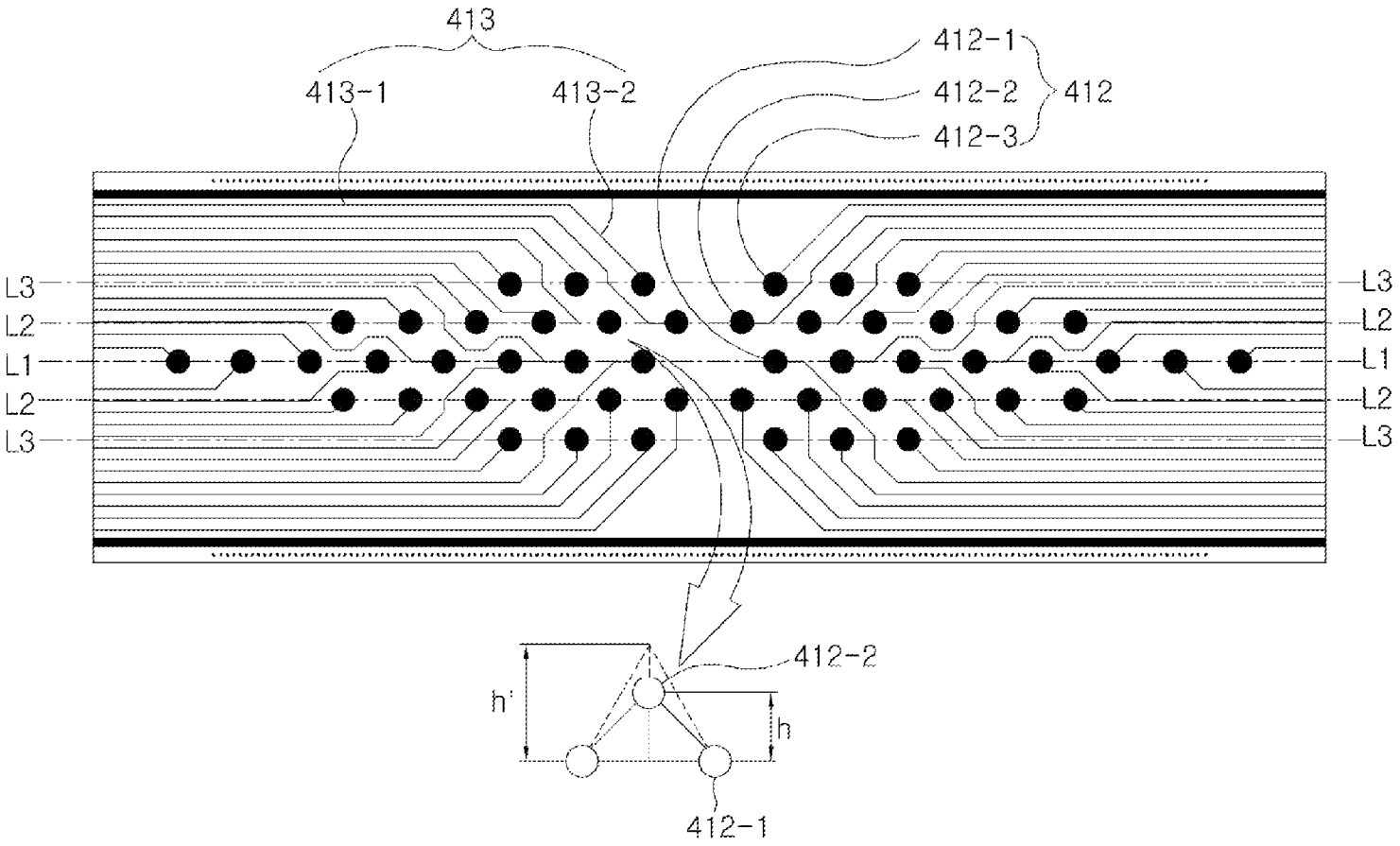
FIG. 6 is an enlarged view schematically illustrating an arrangement structure of a board contact terminal and a pattern circuit with respect to an inner region of a head chip mounting portion of the FPCB of FIG. 5.
Figure 7:
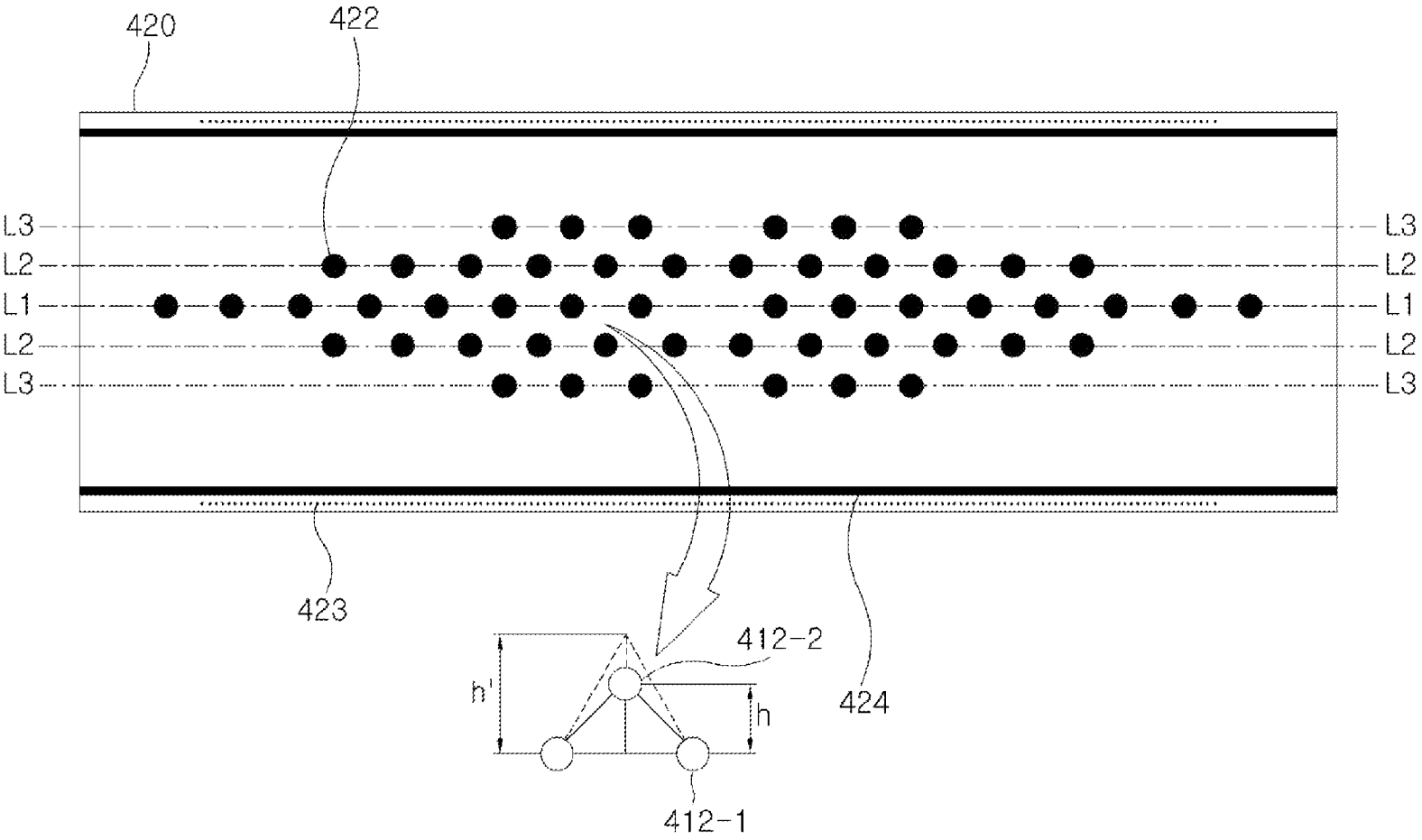
FIG. 7 is a view schematically illustrating an arrangement structure of a chip contact terminal of a head chip, according to an embodiment of the present invention.

FIG. 5 is an exemplary view of a shape of a FPCB, according to an embodiment of the present invention, FIG. 6 is an enlarged view schematically illustrating an arrangement structure of a board contact terminal and a pattern circuit with respect to an inner region of a head chip mounting portion of the FPCB of FIG. 5, and FIG. 7 is a view schematically illustrating an arrangement structure of a chip contact terminal of a head chip, according to an embodiment of the present invention.

First, the head chip mounting portion 411 is formed on the FPCB 410 such that the head chip 420 is mounted as described above, and the plurality of board contact terminals 412 are formed in the inner region of the head chip mounting portion 411. Also, a plurality of pattern circuits 413 are formed in the FPCB 410 to be respectively connected to the board contact terminals 412, wherein the pattern circuits 413 are continuously formed throughout the inner region and an outer region of the head chip mounting portion 411.

In other words, as shown in FIG. 4, a separate body connection contact 414 is formed at one side of the FPCB 410 to be connected to the printer body (not shown), and the board contact terminals 412 formed in the inner region of the head chip mounting portion 411 are each connected to the separate body connection contact 414 through the pattern circuits 413. Here, the pattern circuits 413 are continuously formed throughout the inner region and the outer region of the head chip mounting portion 411 to connect the board contact terminals 412 and the separate body connection contact 414.

Meanwhile, since the board contact terminals 412 are formed in the inner region of the head chip mounting portion 411, which is a relatively large area compared to the related art, the board contact terminals 412 may be disposed in a shape efficiently using the space. For example, the plurality of board contact terminals 412 may be disposed in lines along a plurality of lines L1 through L3 that are parallel to each other.

In detail, as shown in FIG. 6, the board contact terminals 412 may be disposed in lines along the virtual first line L1 passing through a center portion of the head chip mounting portion 411, and the second lines L2 parallel to the first line L1 and bilaterally symmetrical to each other based on the first line L1. Here, the board contact terminals 412 disposed along the first line L1 and the board contact terminals 412 disposed along the second lines L2 may be misaligned in a direction perpendicular to the first line L1.

In other words, board contact terminals 412-2 disposed along the second line L2 may be disposed in sections between board contact terminals 412-1 disposed along the first line, and in this case, the board contact terminals 412-2 may be disposed at the centers of the sections between the board contact terminals 412-1 disposed along the first line L1. In other words, the board contact terminals 412-2 disposed along the second line L2 may be disposed on perpendicular bisectors of the sections between the board contact terminals 412-1 disposed along the first line L1.

According to such an arrangement structure, the two adjacent board contact terminals 412-1 disposed along the first line L1 and one of the board contact terminals 412-2 disposed along the second line L2 form a triangle structure as shown in FIG. 6. Here, a triangle formed by three board contact terminals may be an isosceles triangle in which a section between the two adjacent board contact terminals 412-1 disposed along the first line L1 is the base line. In this case, a height h of the isosceles triangle may be lower than a height h' of an equilateral triangle of which a length of one side is the same as the base line.

In other words, an interval h between the first line L1 and the second line L2 may be smaller than an interval between the board contact terminals 412-1 disposed along the first line L1 such that the three board contact terminals described above form the isosceles triangle having a lower height than the equilateral triangle, and accordingly, widths of the head chip 420 and the head chip mounting portion 411 may be decreased.

Hereinabove, the board contact terminals 412 are disposed in lines along the first and second lines L1 and 12, but as shown in FIG. 6, a plurality of board contact terminals 412-3 may be disposed in lines along the third lines L3 parallel to the second lines L2. Of course, as occasion demands, lines, such as fourth lines and fifth lines, may be continuously added, and the plurality of board contact terminals 412 may be disposed in lines along each of the lines. In this case, the board contact terminals 412-3 disposed along the third line L3 and the board contact terminals 412-2 disposed along the second line L2 may be misaligned in a direction perpendicular to the second line L2.

Meanwhile, the pattern circuits 413 respectively connected to the board contact terminals 412 may each include a parallel portion 413-1 parallel to the first line L1 in the inner region of the head chip mounting portion 411, and a slope portion 413-2 extending from one end of the parallel portion 413-1 in a direction slantly crossing the first line L1, wherein one end of the slope portion 413-2 may be connected to the board contact terminal 412.

Here, the slope portions 413-2 of the pattern circuits 413 respectively connected to the board contact terminals 412 disposed along the first line L1 may be sequentially alternately formed to be located at a left side and a right side based on the first line L1, and accordingly, arrangement space efficiency with respect to the head chip 420 and the head chip mounting portion 411 may be further increased, and the width of the head chip 420 may be minimized.

Also, some of the pattern circuits 413 connected to the board contact terminals 412 may be formed such that the slope portions 413-2 are formed in a direction crossing the section between the board contact terminals 412.

According to such a structure, the board contact terminals 412 may be disposed to have an enlarged interval in the inner region of the head chip mounting portion 411, and accordingly, a mounting operation of the head chip 420 may be easily performed without having to perform an operation requiring a high level of precision.

Meanwhile, FIG. 7 illustrates an arrangement structure of the chip contact terminals 422 of the head chip 420, and the arrangement structure corresponds to that of the board contact terminals 412 described above, and thus details thereof are not provided again.

Also, the plurality of ejection nozzles 423 for discharging ink as described above are formed in lines at two edge portions of the head chip 420 in a width direction, and ink penetration preventing line 424 is separately formed in an inner portion of the ejection nozzles 423 as shown in FIG. 7 such that ink is prevented from penetrating into the inner region of the head chip 420. The ink penetration preventing line 424 may have a shape of a soldering line, and may cross an entire section of the head chip 420 along a length direction such that the ejection nozzles 423 are separated in a separate division.

Here, an ink penetration preventing line 415 is formed in the head chip mounting portion 411 in the same manner as and at a location corresponding to the ink penetration preventing line 424 formed in the head chip 420. Accordingly, while the head chip 420 is mounted on and combined to the head chip mounting portion 411, the ink penetration preventing lines 424 and 415 respectively formed in the head chip 420 and the head chip mounting portion 411 are sealed and combined to each other via soldering.

According to such a structure, while ink is discharged through the ejection nozzles 423, the ink may be prevented from penetrating into the inner region of the head chip 420, in detail, into a region where the chip contact terminals 422 are formed, and accordingly, the chip contact terminals 422 are prevented from being short-circuited by the ink, and thus a print operation may be accurately and stably performed.

While this invention has been particularly shown and described with reference to embodiments thereof, it will be understood by those of ordinary skill in the art that various changes in form and details may be made therein without departing from the spirit and scope of the invention as defined by the appended claims. The embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. An ink cartridge for an inkjet printer, the ink cartridge comprising:

a housing body storing ink in an internal space; and a print head mounted on the housing body such as to discharge the ink stored in the housing body, wherein the print head comprises a flexible printed circuit board (FPCB) combined to one side of the housing body, and a head chip comprising a plurality of ejection nozzles to discharge ink and mounted on the FPCB, wherein the head chip is mounted on the FPCB in a ball grid array (BGA) manner, wherein the FPCB comprises a head chip mounting portion in which a plurality of board contact terminals are formed in the BGA manner in an inner region such that the head chip is mounted in the BGA manner and the head chip is mounted on the head chip mounting portion in the BGA manner as a plurality of chip contact terminals are formed in the BGA manner at locations corresponding to the plurality of board contact terminals, wherein the plurality of board contact terminals are spaced apart from each other at regular intervals along a first line passing through a center portion of the head chip mounting portion and second lines that are parallel to the first line and are bilaterally symmetrical to each other based on the first line, and wherein the board contact terminals disposed along the first line and the board contact terminals disposed along the second lines are misaligned in a direction perpendicular to the first line.

2. The ink cartridge of claim 1, wherein a plurality of pattern circuits are formed on the FPCB to be respectively connected to the plurality of board contact terminals, and the plurality of pattern circuits are continuously formed throughout the inner region and an outer region of the head chip mounting portion.

3. The ink cartridge of claim 1, wherein the two adjacent board contact terminals disposed along the first line and one board contact terminal from among the board contact terminals disposed along the second lines are disposed in a shape of an isosceles triangle in which a section between the two adjacent board contact terminals disposed along the first line is a base line.

4. The ink cartridge of claim 1, wherein a height h of the isosceles triangle is lower than a height h' of an equilateral triangle of which a length of one side is same as the base line.

5. The ink cartridge of claim 2, wherein the plurality of pattern circuits respectively connected to the plurality of board contact terminals comprise parallel portions that are parallel to the first line in the inner region of the head chip mounting portion, and slope portions extending from one ends of the parallel portions in a direction slantly crossing the first line, and wherein one ends of the slope portion are respectively connected to the plurality of board contact terminals.

6. The ink cartridge of claim 5, wherein some of the plurality of pattern circuits respectively connected to the plurality of board contact terminals are formed in a direction in which the slope portions cross sections between the plurality of board contact terminals.

7. The ink cartridge of claim 5, wherein the slope portions of the plurality of pattern circuits respectively connected to the board contact terminals disposed along the first line are sequentially alternately formed to be located at a left side and a right side based on the first line.

8. The ink cartridge of claim 5, wherein ink penetration preventing lines are formed and hermetically combined to each other at two edge portions of the head chip and the head chip mounting portions such that ink does not penetrate into the plurality of chip contact terminals and the plurality of board contact terminals.

* * * * *